US005509549A

United States Patent [19]

Marandola

[11] Patent Number: 5,509,549

[45] Date of Patent: Apr. 23, 1996

[54] BABY BOTTLE ASSEMBLY

[76] Inventor: Daria X. Marandola, 13 Sierra Vista, Laguna Niguel, Calif. 92677

[21] Appl. No.: 366,680

[22] Filed: Dec. 30, 1994

[51] Int. Cl.[6] ..... A61J 9/00; A61J 9/06; A61J 9/08; A61J 11/00

[52] U.S. Cl. ..... 215/11.3; 215/11.1; 215/11.6

[58] Field of Search ..... 215/11.1, 11.3, 215/11.6

[56] References Cited

U.S. PATENT DOCUMENTS

| | | | |
|---|---|---|---|
| 2,881,935 | 4/1959 | Garred | 215/11.3 |
| 3,055,525 | 9/1962 | Coleman, Jr. | 215/11.1 |
| 3,075,666 | 1/1963 | Hoffstein | 215/11 |
| 3,394,018 | 7/1968 | Velonis et al. | 215/11.6 X |
| 3,395,822 | 8/1968 | Donleavy | 215/11.3 |
| 3,593,821 | 7/1971 | Bundy et al. | 215/11.3 |
| 3,871,542 | 3/1975 | Hammer | 215/11.3 |
| 4,238,040 | 12/1980 | Fitzpatrick | 215/11 |
| 4,600,104 | 7/1986 | Yanase | 383/35 X |
| 4,640,425 | 2/1987 | Cabernoch | 215/11.1 X |
| 4,657,151 | 4/1987 | Cabernoch | 215/11 |
| 4,700,856 | 10/1987 | Campbell et al. | 215/11.1 X |
| 4,711,359 | 12/1987 | White et al. | 215/11.1 |
| 4,813,556 | 3/1989 | Lawrence | 215/11.3 |
| 5,033,631 | 2/1990 | Nightingale | 215/11.1 |
| 5,105,956 | 4/1992 | Lin | 215/11.1 |
| 5,109,996 | 5/1992 | Sullivan | 215/11.6 |
| 5,178,291 | 1/1993 | Piercey | 215/11.1 |
| 5,269,425 | 3/1993 | Gomez-Acevedo | 215/11.1 |
| 5,269,426 | 12/1993 | Morano | 215/11.6 |
| 5,273,171 | 12/1993 | Rowland | 215/11.1 |
| 5,275,298 | 1/1994 | Holley, Jr. | 215/11.4 |
| 5,316,160 | 5/1994 | Cautereels | 215/11.1 |
| 5,385,251 | 1/1995 | Dunn | 215/11.3 |

FOREIGN PATENT DOCUMENTS

| | | | |
|---|---|---|---|
| 2022045 | 1/1992 | Canada | 215/11.3 |
| 63033 | 10/1982 | European Pat. Off. | 215/11.3 |
| 974401 | 2/1951 | France | 215/11.3 |
| 602103 | 7/1978 | Switzerland | 215/11.6 |
| 2003039 | 3/1979 | United Kingdom | 215/11.6 |
| 9309754 | 5/1993 | WIPO | 215/11.6 |

*Primary Examiner*—Sue A. Weaver
*Attorney, Agent, or Firm*—Stetina Brunda & Buyan

[57] ABSTRACT

A bottle assembly for feeding an infant comprising a hollow exterior housing having open top and bottom ends, and a disposable insert member selectively insertable into and releasably attachable to the housing. The insert member comprises the nipple portion and a sack portion extending from the nipple portion which is adapted to be filled with a liquid. The nipple portion protrudes from the top end of the housing and the sack portion resides within the housing when the insert member is secured thereto.

15 Claims, 2 Drawing Sheets

50
50
52
52
10
18
22
12
46
20
48
38
40b 26
32
14
10
28
18
18
12
22
46
20
40a
16
48
40
34
38
42
44
40b 32
30
34
100
102
104
38
24

26
32
5
28
24
30
34

26
28
32
30

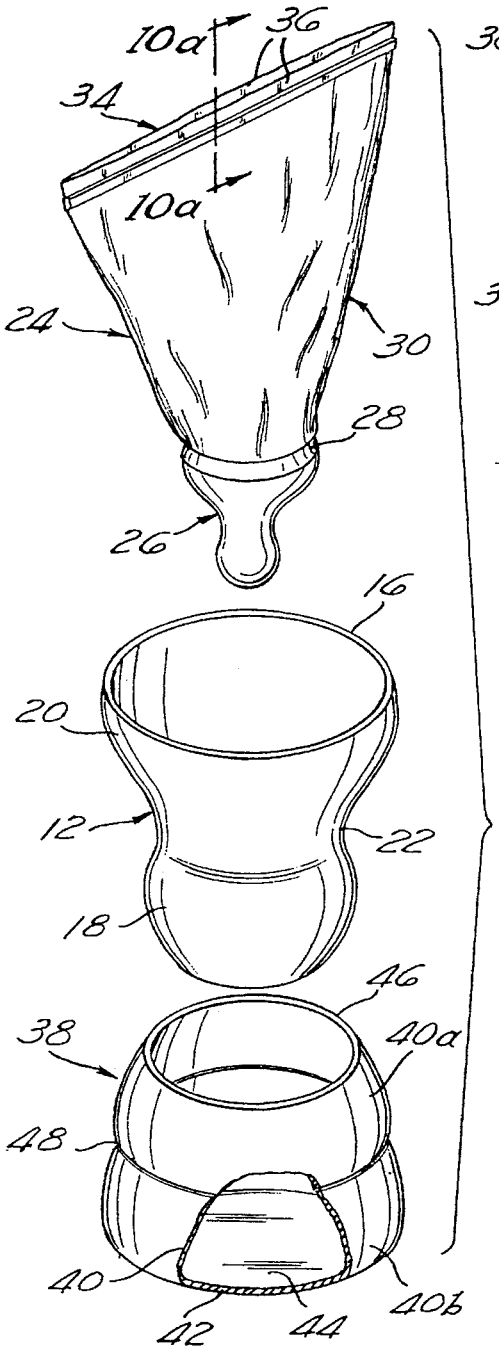
Fig. 6
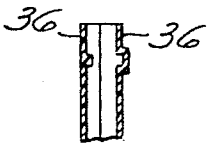
Fig. 10a
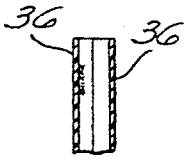
Fig. 10b
Fig. 7
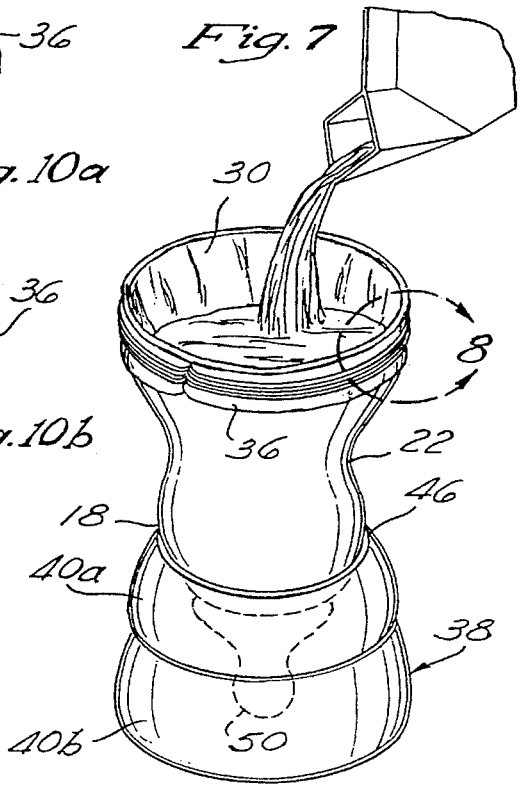
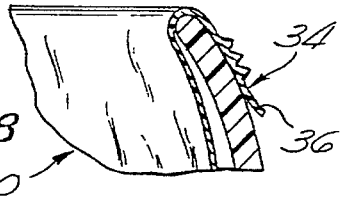
Fig. 8
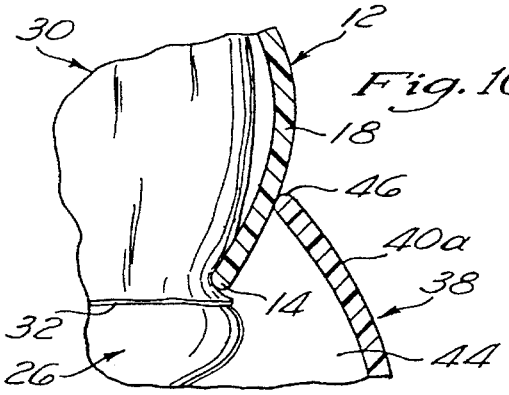
Fig. 10
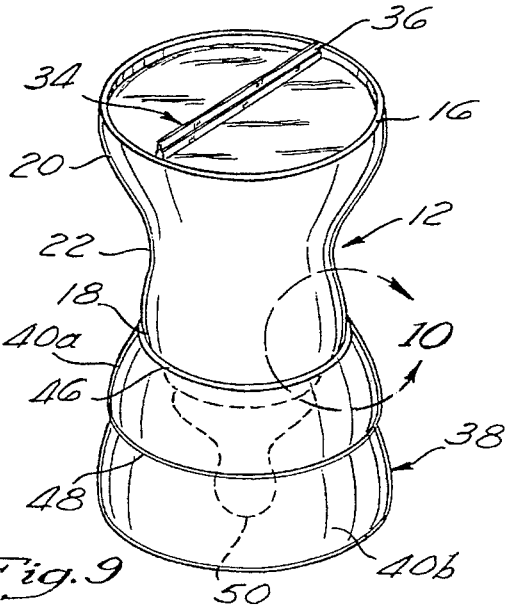
Fig. 9

BABY BOTTLE ASSEMBLY

FIELD OF THE INVENTION

The present invention relates generally to baby bottles, and more particularly to a baby bottle assembly comprising an exterior housing and a disposable insert member which includes a sack portion and an integral nipple portion.

BACKGROUND OF THE INVENTION

In the prior art, conventional baby bottles typically comprise four (4) components. These components include a plastic bottle having an externally threaded neck portion, an internally threaded plastic ring, a rubber nipple, and a plastic cap or cover. Typically, the baby bottle is utilized by initially inserting the nipple into the ring in a manner facilitating the engagement of the nipple and ring to each other. Subsequent to the filling of the bottle with a liquid such as formula, milk, apple juice, etc., the ring (including the nipple engaged thereto) is threadably connected to the bottle. The bottle is generally provided in a variety of external shapes, the most common of which is a generally cylindrical configuration. The bottle is also typically available in a wide variety of colors, and often includes decorative indicia thereon. The cap is releasably attachable to the ring and used to cover the nipple for protecting the same from inadvertent contamination. In this respect, the cap is typically employed when the bottle is stored in a refrigerator or placed in a diaper bag for travel.

Though the previously described baby bottle provides for the feeding of an infant, the bottle possesses certain deficiencies which detracts from its overall utility. Foremost of these deficiencies is the necessity of having to thoroughly clean and disinfect each of the aforementioned components subsequent to a feeding to prevent the inadvertent transmission of any contaminants to the infant. Typically, the proper disinfection of these components requires the immersion thereof into boiling water, which is both a tedious and time-consuming process. Additionally, due to the difficulties attendant to cleaning the bottle, parents will frequently purchase large numbers of bottles which, though reducing the number of times the cleaning/disinfecting process must be conducted, is expensive. Adding to this expense is the need to replace the rubber nipple of the bottle at relatively frequent intervals due to prolonged use typically resulting in an improper flow rate of the liquid therefrom.

In recognition of the deficiencies associated with the previously described prior art baby bottles, and in particular the risk of inadvertent contamination if the components of the baby bottle are not properly cleaned and disinfected, there has also been developed in the prior art baby bottle assemblies incorporating disposable liners. An example of one such bottle assembly is the Playtex Nurser® which comprises five (5) separate components. These components include a cylindrically configured outer protective tube which is open at both ends and includes an externally threaded region adjacent one end thereof. The outer tube is typically fabricated from a substantially transparent plastic material, and includes fluid level markings formed or printed thereon. In addition to the outer tube, the bottle assembly comprises a collapsible liquid sack or liner having an open end and a closed end, an internally threaded plastic ring, a rubber nipple, and a plastic cap or cover. The bottle assembly is typically utilized by inserting the liner into the outer tube and folding the edge thereof defining the open end over the externally threaded region of the outer tube. Subsequent to filling the liner with liquid to a desired level, the ring (which includes the nipple engaged thereto) is threadably connected to the outer tube. Upon completion of the feeding, the ring/nipple assembly is detached from the outer tube, and the now empty liner removed from within the outer tube and discarded. Like the bottle, the liner typically includes fluid level markings printed thereon.

Unfortunately, the five-piece bottle assembly also possesses many of the same deficiencies associated with the previously described four-piece bottle. In this respect, although the outer tube need not be cleaned subsequent to each feeding, the nipple and ring must each be cleaned and disinfected in the previously described manner, as must the cap if utilized. Additionally, after prolonged use the nipple must be replaced for the same reasons previously discussed. Further, the five-piece construction of the bottle assembly is cumbersome and requires a significant amount of time to properly attach the various components to each other in the proper manner. Moreover, the external configuration of the outer tube (as well as the bottle of the four-piece system) is not optimal for weaning an infant from breast feeding to bottle feeding. In this respect, the visual and tactile differences between the mother's breast and outer tube or bottle often makes the transition from breast to bottle difficult for the infant.

The present invention overcomes these and other deficiencies associated with prior art bottle assemblies by providing a bottle assembly which comprises only three (3) components. In particular, the bottle assembly constructed in accordance with the present invention includes an exterior housing and a disposable insert member which comprises nipple and sack portions. The bottle assembly also includes a cap member which may be employed to protect the nipple portion of the insert member from inadvertent contamination. Due to the entire insert member (including the nipple and sack portions) being disposable after each feeding, the risk of inadvertently passing contaminants to the infant is minimized. Additionally, the substantial elimination of the cleaning/disinfecting procedure (only the cap must be cleaned and sterilized if used) makes use of the present bottle assembly significantly less cumbersome then those constructed in accordance with the prior art.

SUMMARY OF THE INVENTION

In accordance the present invention, there is provided a bottle assembly for feeding an infant. The bottle assembly comprises a hollow exterior housing having open top and bottom ends. Selectively insertable into and releasably attachable to the housing is a disposable insert member. The insert member comprises a nipple portion and a sack portion which extends from the nipple portion and is adapted to be filled with a liquid. The nipple portion protrudes from the top end of the housing and the sack portion resides within the housing when the insert member is secured thereto. In the preferred embodiment, the housing includes an upper rim which defines the open top end thereof, with the nipple portion including a continuous channel formed thereabout. The receipt of the upper rim into the channel facilitates the releasable attachment of the insert member to the housing.

The sack portion of the insert member defines a top edge which is attached to the nipple portion and a bottom edge which is selectively openable to facilitate the filling of the sack portion with the liquid and sealable to maintain the liquid within the sack portion. The width of the bottom edge exceeds the width of the top edge, with the bottom edge preferably defining a pair of bottom edge segments which are releasably attachable to each other via a layer of adhesive applied to one of the bottom edge segments of the pair. Alternatively, the pair of bottom edge segments may be releasably attachable to each other via the receipt of a flange extending along one bottom edge segment of the pair into a complementary trough extending along the other bottom edge segment of the pair. The top edge of the sack portion is preferably attached to the nipple portion via an adhesive, though the same may alternatively be attached to the nipple portion via a heat bonding process. Additionally, the nipple portion is preferably fabricated from silicone or rubber and includes a protective covering applied thereto, with the sack portion preferably being fabricated from a plastic film.

In the preferred embodiment, the housing is fabricated from a substantially transparent plastic material and comprises a generally bulbous upper portion defining the top end of the housing, a generally bulbous lower portion defining the bottom end of the housing and a central portion formed between the upper and lower portions. The maximum width of the upper portion exceeds the maximum width of the central portion, with the maximum width of the lower portion exceeding the maximum width of the upper portion. The housing may alternatively be formed to have a generally cylindrical configuration. The bottle assembly constructed in accordance with the present invention further comprises a cap member which is selectively positionable in a first orientation wherein the cap member is extended over the top end of the housing and the nipple portion protruding therefrom, and a second orientation wherein the cap member is partially inserted into the bottom end of the housing. The cap member is frictionally maintained over the top end of the housing and within the bottom end of the housing.

BRIEF DESCRIPTION OF THE DRAWINGS

These, as well as other features of the present invention, will become more apparent upon reference to the drawings wherein:

FIG. 6 is an exploded view of the various components comprising the bottle assembly;

FIG. 7 is a perspective view illustrating the manner in which the insert member of the bottle assembly is filled with a liquid;

FIG. 8 is a partial cross-sectional view of the region encircled in FIG. 7;

FIG. 9 is a perspective view illustrating the manner in which the insert member is closed and sealed subsequent to being filled with a liquid;

FIG. 10 is a partial cross-sectional view of the region encircled in FIG. 9;

FIG. 10*a* is a partial cross-sectional view of the bottom edge of the sack portion taken along line 10*a*—10*a* of FIG. 10 illustrating a flange and complimentary trough extending along respective ones of the bottom edge segments thereof; and FIG. 10*b* is a partial cross-sectional view of an alternative embodiment of the bottom edge of the sack portion illustrating a layer of adhesive applied to one of the bottom edge segments thereof.

DETAILED DESCRIPTION OF THE PREFERRED EMBODIMENT

Figures 1, 2, 3, 4, 5, 11:
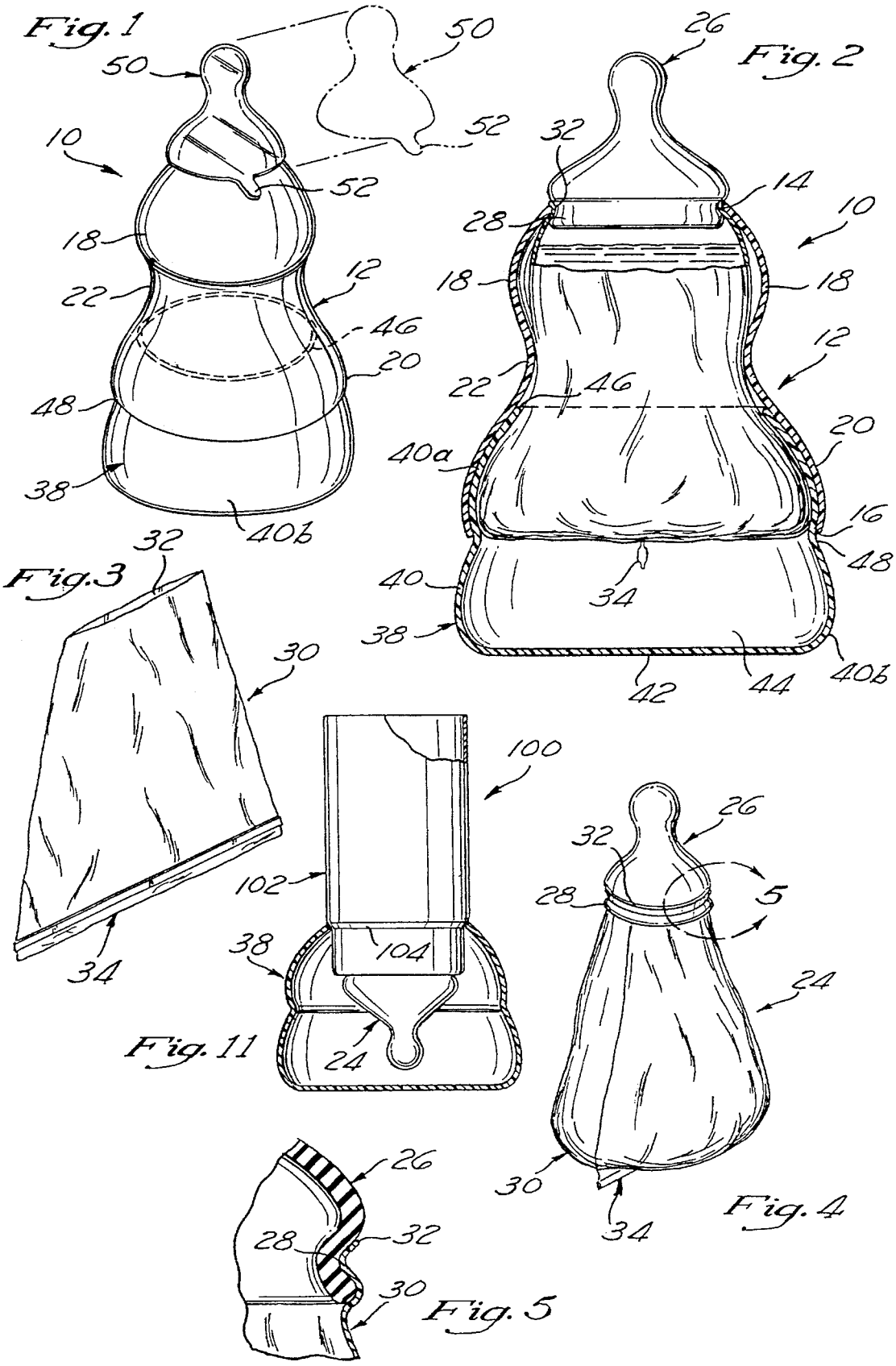
FIG. 1 is a perspective view of the bottle assembly constructed in accordance with the present invention.
FIG. 2 is a cross-sectional view of the bottle assembly.
FIG. 3 is a perspective view of the sack portion of an insert member included with the bottle assembly.
FIG. 4 is a perspective view of the insert member included with the bottle assembly.
FIG. 5 is a partial cross-sectional view of the region encircled in FIG. 4.
FIG. 11 is a side elevational view of a bottle assembly incorporating an alternative housing.

Referring now to the drawings wherein the showings are for purposes of illustrating a preferred embodiment of the present invention only, and not for purposes of limiting the same, FIG. 1 perspectively illustrates an infant feeding bottle assembly 10 constructed in accordance with the present invention.

As best seen in FIGS. 1 and 2, the bottle assembly 10 comprises a hollow exterior housing 12 having open top and bottom ends. The open top end of the housing 12 is defined by an annular upper rim 14, with the open bottom end being defined by an annular lower rim 16. In the preferred embodiment, the housing 12 has an overall configuration which roughly approximates the shape and contour of a female breast. In particular, the housing 12 comprises a bulbous upper portion 18 which defines the open top end thereof, and a bulbous lower portion 20 which defines the open bottom end thereof. Formed between the upper and lower portions 18, 20 is a reduced diameter central portion 22. The maximum width (i.e., diameter) of the upper portion 18 exceeds the maximum width (i.e., diameter) of the central portion 22, with the maximum width (i.e., diameter ) of the lower portion 20 exceeding the maximum width of the upper portion 18. The housing 12 is preferably fabricated from a substantially transparent plastic material, and may include decorative indicia applied thereto. The advantages attendant to forming the housing 12 with the previously described configuration will be discussed in more detail below.

Referring now to FIGS. 2–5, in addition to the housing 12, the bottle assembly 10 comprises a disposable insert member 24 which is insertable into the housing 12 and releasably attachable thereto. In the preferred embodiment, the insert member 24 comprises a nipple portion 26 which is preferably fabricated from silicone, rubber or a similar material, and includes a continuous channel 28 formed thereabout. Attached to and extending from the nipple portion 26 is a sack portion 30 which is adapted to be filled with a liquid. The sack portion 30 will typically be sized to hold 4 ounces or 8 ounces of the liquid, though it will be recognized that the same may be sized to accommodate other volumes of the liquid. The sack portion 30 is preferably fabricated from a substantially transparent plastic film and defines a top edge 32 which is attached to the nipple portion 26 and a bottom edge 34 which is selectively openable to facilitate the filling of the sack portion 30 with the liquid, and sealable to maintain the liquid within the sack portion 30. As best seen in FIG. 4, the sack portion 30 has a generally trapezoidal configuration, with the width of the bottom edge 34 exceeding the width of the top edge 32 thereof. When attached to the nipple portion 26, the top edge 32 of the sack portion 30 resides within the channel 28 formed about the nipple portion 26. The attachment of the sack portion 30, and in particular the top edge 32 thereof, to the nipple portion 26 may be accomplished via an adhesive, or alternatively via a heat bonding process. Though not shown, the sack portion 30 may include fluid level markings printed thereon. Though preferably fabricated from the separate nipple and sack portions 26, 30 which are attached to each other, it will be recognized that the insert member 24 may be formed as a unitary structure which includes the nipple and sack portions 26, 30.

In the preferred embodiment, the bottom edge 34 of the sack portion 30 defines a pair of bottom edge segments 36 which extend in generally parallel, side-by-side relation. To facilitate the selective opening and closure/sealing of the bottom edge 34, the bottom edge segments 36 are releasably attachable to each other via the receipt of a flange extending along one bottom edge segment 36 of the pair into a complimentary trough extending along the other bottom edge segment 36 of the pair (FIG. 10*a*). As will be recognized, such flange and trough assembly is similar in construction to the closure feature included on many varieties of sandwich and freezer bags. As an alternative to the flange and complimentary trough, the bottom edge segments 36 may be releasably attachable to each other via a layer of adhesive applied to one of the bottom edge segments 36 of the pair (FIG. 10*b*).

Referring now to FIGS. 1, 2, 7 and 9, the bottle assembly 10 constructed in accordance with the present invention may further comprise a cap member 38 which is selectively positionable in the first orientation (shown in FIGS. 7 and 9) wherein the cap member 38 is extended over the top end of the housing 12, and a second orientation (shown in FIGS. 1 and 2) wherein the cap member 38 is partially inserted into the bottom of the housing 12. The cap member 38 comprises a side wall 40 and a bottom wall 42 which define an interior compartment 44. The side wall 40 defines an annular rim 46 which itself defines the entrance to the interior compartment 44. Formed approximately midway within the side wall 40 and extending circumferentially thereabout is a recessed portion 48 which divides the side wall 40 into a first region 40*a* (which defines the rim 46) and a second region 40*b*. In the preferred embodiment, the side wall 40 is of gradually increasing diameter, with the maximum diameter of the second region 40*b* exceeding the maximum diameter of the first region 40*a*.

As best seen in FIGS. 8–10, when the cap member 38 is extended over the top end of the housing 12 (and in particular the upper portion 18 thereof), the same is frictionally maintained thereon. In this respect, the cap member 38 is preferably fabricated from a non-opaque plastic material, with the side wall 40 possessing sufficient resiliency such that the first region 40*a* thereof may be flexed or bowed slightly outwardly when extended over the upper portion 18 of the housing 12, thus causing the rim 46 to be biased against and therefore frictionally maintained upon the outer surface of the upper portion 18. The extension of the cap member 38 over the top end of the housing 12 is preferably terminated when the rim 46 occupies a position which is approximately at the largest diameter region of the upper portion 18. As will be recognized, when the cap member 38 is properly extended over the top end of the housing 12, approximately half of the upper portion 18 resides within the interior compartment 44 of the cap member 38. Though not shown, the outer surface of the upper portion 18 may be provided with a detent to accommodate the rim 46 of the cap member 38.

As seen in FIGS. 1 and 2, the cap member 38 is also frictionally maintained within the bottom end of the housing 12 (and in particular the lower portion 20 thereof). The partial insertion of the cap member 38 into the bottom end of the housing 12 is accomplished by the passage of the first region 40*a* of the side wall 40 through the lower rim 16 and along the inner surface of the lower portion 20 of the housing 12. The insertion of the cap member 38 into the housing 12 is terminated when the lower rim 16 enters the recessed portion 48 of the side wall 40 (as shown in FIG. 2). When the lower rim 16 is received into the recessed portion 48, the rim 46 of the cap member 38 terminates just short of the central portion 22 of the housing 12. Importantly, when the first region 40*a* is inserted into the bottom end of the housing 12, the same is flexed or bowed slightly inwardly. As such, when fully inserted into the housing 12, the first region 40*a* is abutted and biased against the inner surface of the lower portion 20, thus maintaining the cap member 38 in frictional engagement to the housing 12.

Referring now to FIG. 1 the nipple portion 26 of the insert member 24 may include a protective covering 50 which is removably applied thereto. The protective covering 50 is preferably fabricated from a plastic film (e.g., polyethylene) and may be applied to the nipple portion 26 via a shrink wrapping process. Additionally, the protective covering 50 is preferably sized such that the same does not extend into the channel 28 formed about the nipple portion 26. The removal of the protective covering 50 from the nipple portion 26 is accomplished by the pulling of an integral tab portion 52 which extends upwardly from its peripheral edge. As will be discussed in more detail below, the protective covering 50 prevents inadvertent contamination of the nipple portion 26 prior to the feeding of the infant.

Having thus described the components comprising the bottle assembly 10, the preferred method of utilizing the same will now be discussed. Initially, the cap member 38 is extended over the upper portion 18 of the housing 12 in the aforementioned manner, with the bottom wall 42 of the cap member 38 then being rested upon a substantially flat surface, thus supporting the housing 12 in an upright orientation (with the lower rim 16 thereof facing upward) as shown in FIG. 7. In this respect, the housing 12 is supported solely by the cap member 38, and need not be provided with any additional external support. Thereafter, a insert member 24 (including the protective covering 50 applied to the nipple portion 26) is inserted, nipple portion first, into the open bottom end of the housing 12. The bottom edge segments 36 of the sack portion 30 are then folded over the lower rim 16 of the housing 12. When the bottom edge segments 36 are folded over the lower rim 16, almost the entire nipple portion 26 of the insert member 24 resides within the upper portion 18 of the housing 12.

Subsequent to the folding of the bottom edge segments 36 over the lower rim 16, the interior of the sack portion 30 is filled with a suitable liquid such as formula, milk, fruit juice, etc. After the sack portion 30 has been filled with the liquid, the bottom edge segments 36 thereof are removed from the lower rim 16 and sealed to each other in the previously described manner, thus maintaining the liquid within the sack portion 30. Upon the sealing of the bottom edge segments 36, the cap member 38 is removed from the upper portion 18 of the housing 12, and the nipple portion 26 grasped and pulled through the upper rim 14 of the housing 12 until such time as the upper rim 14 is received into the channel 28 of the nipple portion 26. As will be recognized, the rubber construction of the nipple portion 26 allows the enlarged peripheral region thereof immediately adjacent the channel 28 to be compressed and pulled through the upper rim 14. The receipt of the upper rim 14 into the channel 28 facilitates the releasable attachment of the insert member 24 to the housing 12.

As best seen in FIG. 2, when the insert member 24 is properly secured to the housing 12, the nipple portion 26 thereof protrudes from the top end of the housing 12, with the sack portion 30 residing within the interior of the housing 12. Importantly, the sack portion 30 is sized such that when the nipple portion 26 is engaged to the housing 12 in the aforementioned manner, the bottom edge segments 36 of the sack portion 30 do not protrude appreciably beyond the lower rim 16. As will be recognized, due to the sack portion 30 preferably being sized in this manner, the bottom edge segments 36 thereof must be folded over the lower rim 16 of the housing 12 prior to the engagement of the nipple portion 26 to the upper rim 14. In this respect, once the nipple portion 26 has been secured to the housing 12, the length of the sack portion 30 is not sufficient to allow the bottom edge segments 36 thereof to be folded over the lower rim 16.

After the insert member 24 has been releasably secured to the housing 12 in the aforementioned manner, the tab portion 52 of the protective covering 50 is pulled upwardly, thus removing the protective covering 50 from the nipple portion 26. Subsequent to the removal of the protective covering 50 from the nipple portion 26, the bottle assembly 10 is ready to be utilized for feeding an infant. Typically, during the feeding, the housing 12 will be grasped at the reduced diameter central portion 22 thereof. Upon the completion of the infant feeding, the nipple portion 26 is pulled, thus facilitating the disengagement of the insert member 24 from the housing 12 and the removal of the now empty sack portion 30 from within the interior thereof. The removal of the insert member 24 from within the housing may also be accomplished by pulling the empty sack portion 30. Assuming that no leakage of the liquid from the sack portion 30 of the insert member 24 has occurred, a new insert member 24 may be interfaced to the housing 12 in the previously described manner in preparation for another feeding, with no cleaning or disinfection of the housing 12 or cap member 38 being required.

Just prior to the removal of the protective covering 50 from the nipple portion 26, the cap member 38 (which was previously extended over the upper portion 18 of the housing 12) may be inserted into the bottom end of the housing 12 in the aforementioned manner. Advantageously, in the event the liquid leaks from the sack portion 30 due to the bottom edge segments 36 thereof being improperly sealed, the insertion of the cap member 38 into the lower portion 20 of the housing 12 prevents any escape of the liquid from therewithin. In this respect, even if the bottom edge segments 36 fully open thus causing all of the liquid to be drained from within the sack portion 30, the liquid will be prevented from flowing out of the open top end of the housing 12 by the seal created between the upper rim 14 and nipple portion 26, and prevented from flowing out of the open bottom end of the housing 12 by the cap member 38, and in particular the second region **40*b* and bottom wall 42** thereof.

It will be recognized that subsequent to the filling of the sack portion 30 with the liquid and engagement of the nipple portion 26 (and hence the insert member 24) to the housing 12, the cap member 38 may be frictionally engaged to the upper portion 18 of the housing 12 in the manner shown in FIGS. 7 and 9 so as to serve as an additional covering for the nipple portion 26 during travel. Alternatively, in view of the inclusion of the protective covering 50 on the nipple portion 26, the cap member 38 may be inserted into the lower portion 20 of the housing 12 for the reasons previously described. Due to the width of the second region **40*b* of the cap member 38 (i.e., the diameter of the bottom wall 42), the cap member 38, when inserted into the bottom end of the housing 12, defines a wide base which provides the bottle assembly 10** with stability when the same is rested upon a substantially flat surface during a break in the feeding.

The bottle assembly 10 constricted in accordance with the present invention provides significant advantages over prior art bottle assemblies in that the same consists of only three (3) components (i.e., the housing 12, insert member 24, and cap member 38) as opposed to four (4) or five (5) components which are included with the previously described prior art bottle assemblies. Additionally, the bottle assembly 10 is hygienically favorable in that the sterile insert member 24 is completely disposable, thus significantly reducing the risk of contaminates being inadvertently passed to the infant during a subsequent feeding. As will be recognized, the risk of such contamination is increased with prior art bottle assemblies in the event the reusable nipples thereof are improperly cleaned and/or sterilized. Due to the collapsibility of the sack portion 30 of the insert member 24, the feeding infant is also less prone to air intake.

As will be recognized, since the housing 12 and insert member 24 are upside down during the filling of the sack portion 30 with the liquid, there is a tendency for one or more drops of the liquid to leak from the nipple portion 26. In this respect, the protective covering 50, in addition to preventing inadvertent contamination of the nipple portion 26, also prevents such leakage from occurring.

Referring now to FIG. 11, there is depicted a bottle assembly 100 which, as an alternative to the previously described housing 12, incorporates a housing 102 which has a generally cylindrical configuration. The housing 102 has open top and bottom ends, and is adapted to have the insert member 24 inserted into the interior thereof and cooperatively engage thereto in the same manner previously described in relation to the housing 12. The housing 102 also preferably includes a continuous detent 104 formed within and circumventing the outer surface thereof in close proximity to the top end for accommodating the rim 46 of the cap member 38. Though not shown, the cap member 38 may also be extended over or partially inserted into the open bottom end of the housing 102.

Additional modifications and improvements of the present invention may also be apparent to those skilled in the art. Thus, the particular combination of parts described and illustrated herein is intended to represent only one embodiment of the present invention, and is not intended to serve as limitations of alternative devices within the spirit and scope of the invention.

What is claimed is:

1. An infant bottle assembly, comprising:

a hollow exterior housing having open top and bottom ends, a generally bulbous upper portion defining the top end, a generally bulbous lower portion defining the bottom end, and a central portion formed between the upper and lower portions, wherein the maximum width of the upper portion exceeds the maximum width of the central portion, and the maximum width of the lower portion exceeds the maximum width of the upper portion; and a disposable insert member selectively insertable into the housing, said insert member comprising:

a nipple portion configured to be releasably attachable to the upper portion of the housing; and a sack portion extending from said nipple portion and defining an opening which allows the sack portion to be filled with a liquid;

said nipple portion protruding from the top end of the housing and said sack portion residing within said housing when said nipple portion is attached thereto.

2. The bottle assembly of claim 1 wherein said housing includes and upper rim which defines the open top end thereof and said nipple portion includes a continuous channel formed thereabout, the receipt of the upper rim into the channel facilitating the releasable attachment of the insert member to the housing.

3. The bottle assembly of claim 1 wherein said sack portion defines a top edge which is attached to the nipple portion and a bottom edge which defines the opening and is sealable in a manner maintaining the liquid within the sack portion.

4. The bottle assembly of claim 3 wherein the top edge of the sack portion is attached to the nipple portion via an adhesive.

5. The bottle assembly of claim 3 wherein the top edge of the sack portion is attached to the nipple portion via a heat bonding process.

6. The bottle assembly of claim 3 wherein said nipple portion is fabricated from rubber.

7. The bottle assembly of claim 3 wherein said nipple portion is fabricated from silicone.

8. The bottle assembly of claim 3 wherein said sack portion is fabricated from a substantially transparent plastic film.

9. The bottle assembly of claim 3 wherein the width of the bottom edge of the sack portion exceeds the width of the top edge thereof.

10. The bottle assembly of claim 3 wherein the bottom edge of the sack portion defines a pair of bottom edge segments which are releasably attachable to each other via a layer of adhesive applied to one of the bottom edge segments of the pair.

11. The bottle assembly of claim 3 wherein the bottom edge of the sack portion defines a pair of bottom edge segments which are releasably attachable to each other via the receipt of a flange extending along one bottom edge segment of the pair into a complementary trough extending along the other bottom edge segment of the pair.

12. The bottle assembly of claim 1 wherein said housing is fabricated from a substantially transparent plastic material.

13. The bottle assembly of claim 1 further comprising a cap member which is selectively positionable in a first orientation wherein said cap member is partially extended over the upper portion of the housing and covers the nipple portion protruding therefrom, and a second orientation wherein said cap member is partially inserted into the bottom end of the housing.

14. The bottle assembly of claim 13 wherein said cap member is sized and configured relative to the housing so as to be frictionally maintained over the upper portion when in the first orientation and frictionally maintained within the bottom end when in the second orientation.

15. The bottle assembly of claim 1 wherein the insert member further comprises a protective covering removably applied to the nipple portion thereof.

* * * * *